US005425534A

United States Patent [19]

Chen

[11] Patent Number: 5,425,534

[45] Date of Patent: Jun. 20, 1995

[54] BADMINTON RACKET HANDLE STRUCTURE

[76] Inventor: Hon-Chy Chen, No. 1, Alley 6, Lane 221, Hsing Lung Road, Section 3, Wen Shan, China

[21] Appl. No.: 121,865

[22] Filed: Sep. 17, 1993

[51] Int. Cl.[6] ..... A63B 49/08

[52] U.S. Cl. ..... 273/735

[58] Field of Search ..... 273/735, 73 R, 75, 67 R, 273/67 DA, 67 DB, 81 R, 81 B

[56] References Cited

U.S. PATENT DOCUMENTS

| | | | |
|---|---|---|---|
| 412,479 | 10/1889 | Davis | 273/67 DA |
| 1,839,835 | 1/1932 | Cook | 273/735 X |
| 2,280,382 | 4/1942 | Davis | 273/75 |
| 3,083,968 | 4/1963 | Takahashi | 273/73 R |
| 3,501,148 | 2/1968 | Cheris et al. | 273/735 |
| 3,674,267 | 7/1972 | Hollis | 273/75 |
| 4,278,251 | 7/1981 | Lafourcade | 273/735 X |
| 4,537,399 | 8/1985 | Adam | 273/735 |
| 4,575,082 | 3/1986 | Mott et al. | 273/735 X |
| 5,034,082 | 7/1991 | Nolan | 273/735 X |
| 5,129,656 | 7/1992 | Marte et al. | 273/735 |

*Primary Examiner*—William E. Stoll
*Attorney, Agent, or Firm*—Bacon & Thomas

[57] ABSTRACT

The invention herein relates to a badminton racket handle structure, referring specifically to a structure that eliminates the glued wooden handle structure of conventional badminton rackets by utilizing direct injection molding onto the end of the center shaft of the badminton racket that results in a shell structured handle with a greater degree of precision and stability.

3 Claims, 4 Drawing Sheets

BADMINTON RACKET HANDLE STRUCTURE

BACKGROUND OF THE INVENTION

With regard to conventional badminton rackets, most generally include a frame, a face consisting of gut strung inside the frame, a central shaft extending downward a suitable and predetermined length from the frame and a handle solidly joined on the end of the central shaft that services as a grip for the user. Whether of carbon fiber or aluminum construction, the central shaft at the lower side of the face is always a straight shaft and, furthermore, there is an end of the end of the central shaft for solidly attaching to a wooden polyhedral-shaped handle, wherein emplaced between the handle and the center shaft is a conical section that functions as a retainer and decoration, and the wooden handle is finally wrapped completely in adhesive tape such as PU film. In the general structure of this type of conventional handle section, a hole is drilled through the center of the wooden handle to hold the inserted center shaft, but since the badminton racket handle is subject to considerable impact during a game, every strike generates strong separation and torque forces. Therefore, the points of conjoinment between the center shaft and the inside of the wooden handle must be capable of resisting the occurrence of adverse axial separation and diametrical loosening. At present, however, the center shaft is typically conjoined to the wooden handle with glue and excess space is left if the inner diameter of the hole drilled through the center of the wooden handle is larger than the outer diameter of the center shaft and, given the manual application of glue onto the end as well as the manual placement of the center shaft into the wooden handle before heat drying, the dimensions are difficult to control and the quantity of glue applied is also difficult to control. Furthermore, during assembly it is relatively easy to encounter excessive or sparse and uneven application of glue, resulting in the entire assembly and adhesive method leading to poor quality and the requiring of troublesome procedures, wherein glue must be wiped away if the quantity applied was excessive, a considerate waste of manpower and time, and insufficient adhesion if the quantity of glue applied was too sparse that would also mean a lack of torque resistance. In addition, placed into the heat drying process after assembly and before the adhesion has solidified, extreme measures must be taken to maintain the alignment of the center shaft with the handle because any impact whatsoever can easily lead to misalignment that later results in poor quality. For all of these reasons, this type of conventional racket is limited by the assembly process and results in an increase of both manpower costs and quality control costs, and even the difficult procurement of the lumber for the wooden handles. Moreover, the quality of the lumber, if too heavy, for example, is also difficult to control and involves additional costs. These are the structurally attributed shortcomings of the aforementioned conventional badminton racket.

SUMMARY OF THE INVENTION

The invention herein relates to kind of new type badminton racket handle structure that completely eliminates the conical section and wooden handle of a conventional racket handle. On the end of the original center shaft where the end is positioned a certain distance away along the extent of the center shaft are a number of grooves of appropriate depth. When the end is inserted into the mold and the handle is directly injection molded in the form of a thermoplastic shell structure, the end of the center shaft is conjoined and embedded firmly inside the handle. At the same time, the forming material fills the aforesaid number of grooves, enabling the easy formation of the badminton racket handle and making it possible to eliminate the various disadvantages encountered during the assembly of wooden handles, while also retaining all handle functions.

DETAILED DESCRIPTION OF THE PREFERRED EMBODIMENT

Figure 1:
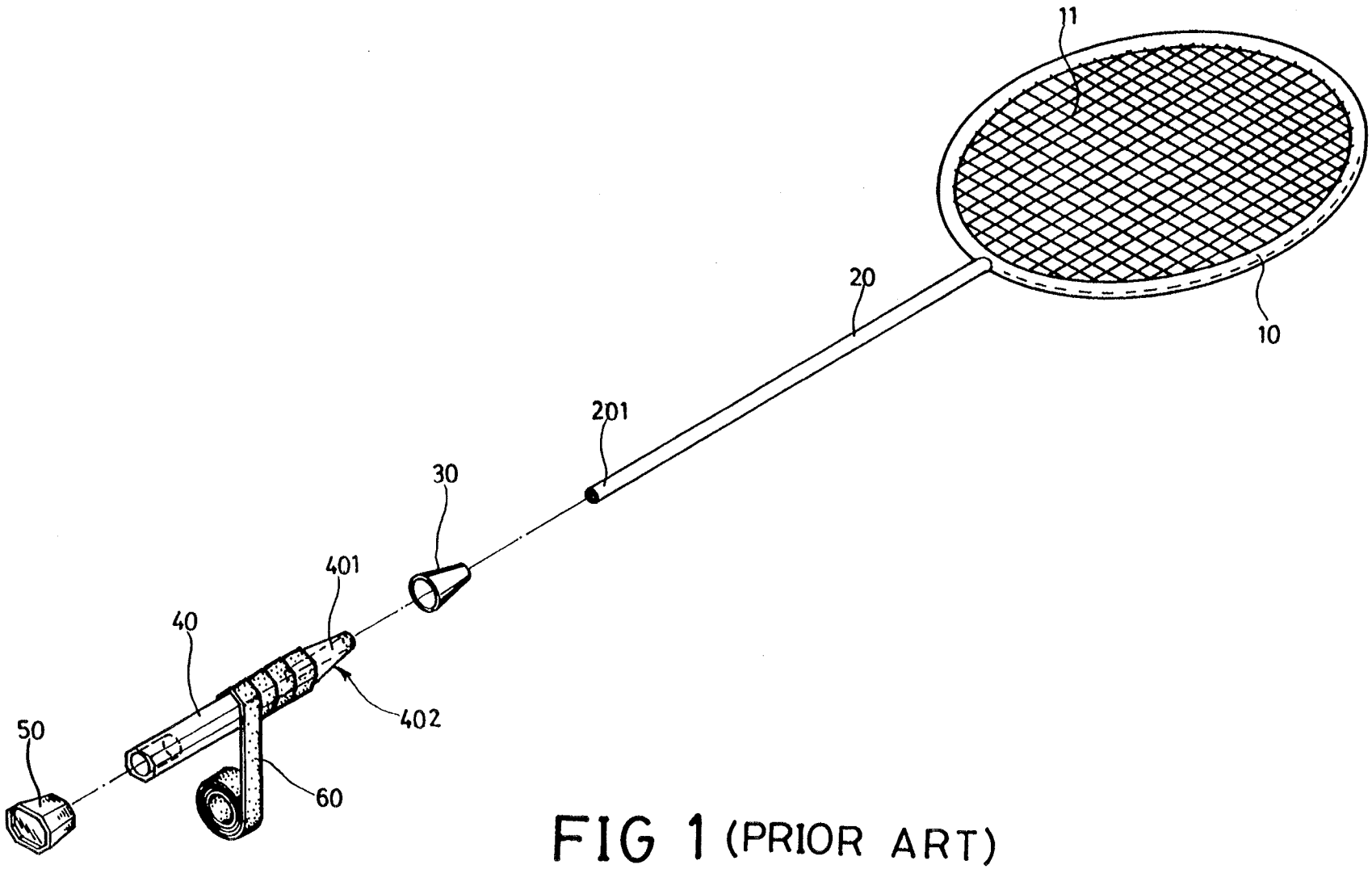
FIG 1 (PRIOR ART)
FIG. 1 is an isometric drawing of a conventional badminton racket structure.

As indicated in FIG. 1, the conventional badminton racket includes a frame (10), a face (11) consisting of racket gut strung inside the aforesaid frame, a tubular center shaft (20) extending from the lower side of the aforementioned frame and a lower end (201) of the center shaft (20) inserted into a conical end piece (30) that can all be defined as comprising the upper structure of a conventional badminton racket. The upper structure is inserted into a centered hole (401) in wooden handle (40) and on the very bottom of the wooden handle (40) is an end cap (50) After the wooden handle is fastened together securely, pliable cloth adhesive tape (60), such as adhesive tape made of PU material that provides grip for the user, is wrapped around the wooden handle. The assembly structure includes the lower end section (201) of the center shaft, the centered hole (401) of the assembly portion and the end section (upper structure) as well as the insertion portion at the upper end (402) of the wooden handle which are all glued together, wherein the most important aspect that influences the quality of a badminton racket is how the centered hole (401) is assembled to the center shaft (20) since an excellent quality badminton racket essentially has a handle and shaft that must be solidly assembled and also perfectly aligned such that there is no occurrence of separation or shortening from loosening due to powerful volleying. However, it is not easy to control the quality of adhesion, especially at the point where the lower end section (201) of the center shaft (20) is inserted into the centered hole (401) drilled into the wooden handle (40), since the excess spacing between the spur section and the centered hole is not easily controlled to an exact degree and therefore the glue is not equally distributed after assembly. In addition to the outflow of excess glue, the unequally distributed glue seriously influences the effective bonding strength existing between the wooden handle and the center shaft, and this of course leads to axial or diametrical loosening. Furthermore, since the excess spacing between the spur section and the centered hole is filled with glue, the wooden handle and the center shaft are in a state of flux before heat drying, thus, controlling the axial alignment of the wooden handle with the center shaft is extremely difficult and if other tooling is utilized, it is also difficult to avoid impact during the assembly process. In terms of current manual assembly processes, it is necessary to take special precautions when sending into the heat dryer and this has created troublesome problems in the manual assembly process, therefore, the structure of conventional badminton rackets has always been subject to the shortcomings of inconvenience and insufficient precision due to existent assembly processes.

Figure 2:
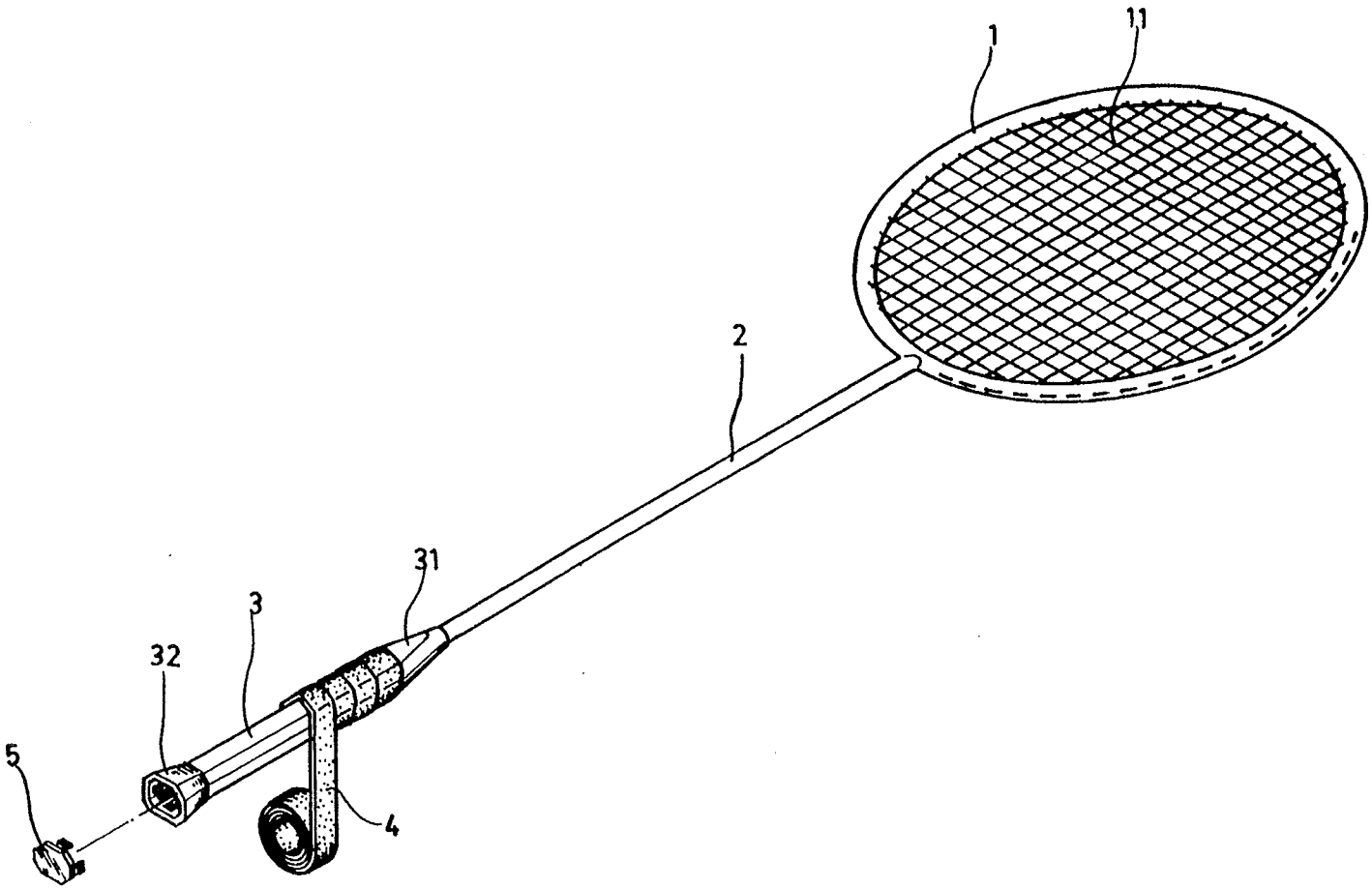
FIG. 2 is an isometric drawing showing the external appearance of the invention herein.

As indicated in FIG. 2, the invention herein includes a frame (1) and a face (11) consisting of gut strung inside the frame (1), a center shaft (2) of tubular stock extending downward from the frame, a handle (3) and cloth adhesive tape (4), of which the handle (3) and conical end section (31) (upper structure) is designed in the shape of a typical badminton handle. These are constructed of thermoplastic, wherein, if carbon fiber is used as reinforcing material and blended with ABS or nylon to form a thermoplastic material that is molded directly onto the end of the center shaft (2) through injection molding to the precision design of the mold and the positional supporting of the prior insertion of the center shaft (2) into the mold during the molding process, therefore, after injection molding, the alignment of the center shaft (2) and the handle (3) can be completely maintained, thereby eliminating the occurrence of misalignment. Furthermore, slots are injection molded on the inner surfaces of the protruding butt section (32) of the handle (3) that accommodates the direct and secure insertion on of the end cap (5) to form a badminton racket handle structure that is of high precision which is also easy to assemble.

Figure 3:
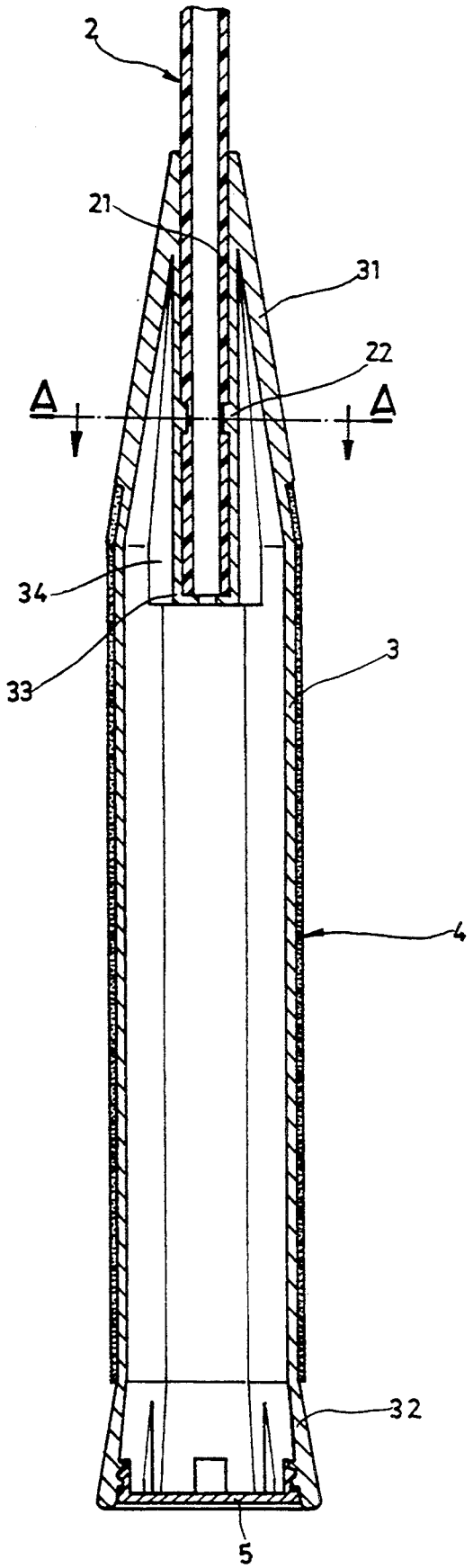
FIG. 3 is a cross-sectional drawing detailing the racket handle of the invention herein taken along line B—B in FIG. 4.
Figure 4:
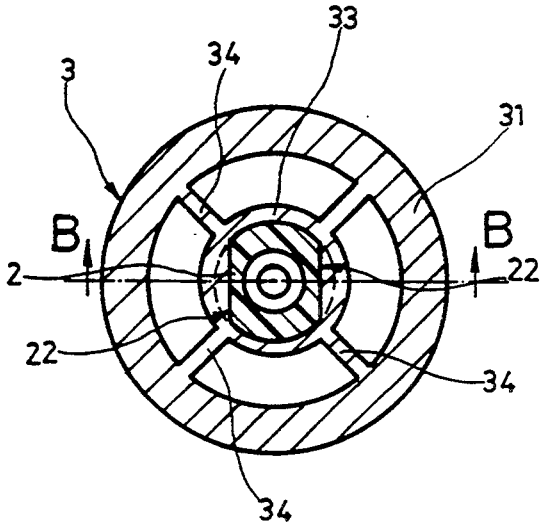
FIG. 4 is a cross-sectional drawing of the planar section delineated by line A—A in FIG. 3.

As indicated in FIG. 3, the cross-sectional drawing of the handle (3) section, the handle (3) consists of an injection molded hollow shell that includes a conical end section (31), protruding butt section (32), a tubular recess (33) positioned inside the end of the shell and four rib supports (34) positioned along the surfaces of the tubular recess and contiguous to the shell. The entire structure is formed by utilizing design molds and injection molding, thus illustrating the drawing of the most advanced embodiment of the invention herein, but since these design molds have their own molding technology and it is commonly known that this kind of technology can be attained by technicians, therefore, the structure of the molds will not be described in detail. Furthermore, the hollow shell of the handle (3) itself offers a high degree of strength when gripped during usage because it is made of selected material, and the tubular recess (33) ensconcing the end (21) of the center shaft (2) is also fortified by rib supports (34), thus enabling a substantial degree of securing that comprises the main innovation of the invention herein. Furthermore, the entire structure of the handle (3) utilizes a mold that is injection molded directly onto the end (21) of the center shaft (2). In other words, whether the center shaft (2) is already joined to the frame (1) or is unjoined and remains a separate center shaft (2), by utilizing a clamp positioning tool and the structural design of the mold for the handle, the center shaft can be first inserted into the insertion hole of the handle mold, thus enabling the end (21) of the center shaft to be positioned inside the area where the material is being injection molded. Furthermore, on the aforesaid end of the center shaft (2), the end (21) is positioned at a certain distance from the end of the center shaft and there are number of grooves (22), with the aforesaid grooves (22) being of appropriate depth along the outer surface of the shaft and there are a minimum of two grooves in juxtaposition relative to the center line of the shaft. As indicated in FIG. 3, due to the grooves (22), during the injection molding and formation of the structure, the tubular recess (33) of the handle (3) forms tightly around the end (21) of the center shaft (2) and at the same time the forming material flows into the hollow recesses of the grooves (22). The width of the grooves (22) perpendicular to the diametrical orientation of the center shaft, as indicated in FIG. 4, enable the structure integration points between the handle (3) and the center shaft (2) to have anti-flexion resilience and the center shaft (2) cannot become loosened inside the handle (3) due to the relative large amount of torque. Furthermore, since the depth of the grooves (22) form a shoulder that produces resistance in an axial orientation along the center shaft (2), the center shaft (2) cannot become misaligned and thereby loosened inside the handle (3). Therefore, the placement of the aforesaid grooves (22) facilitates tight merging during injection molding that enables the handle and center shaft of the badminton racket to have excellent anti-separation quality and thereby attain the basic requirements of stable integration. The precision injection of the mold is a relatively simple process, wherein the degree of precision is advanced and able to overcome the troublesome problems associated with the manufacturing of conventional badminton rackets.

Figure 5:
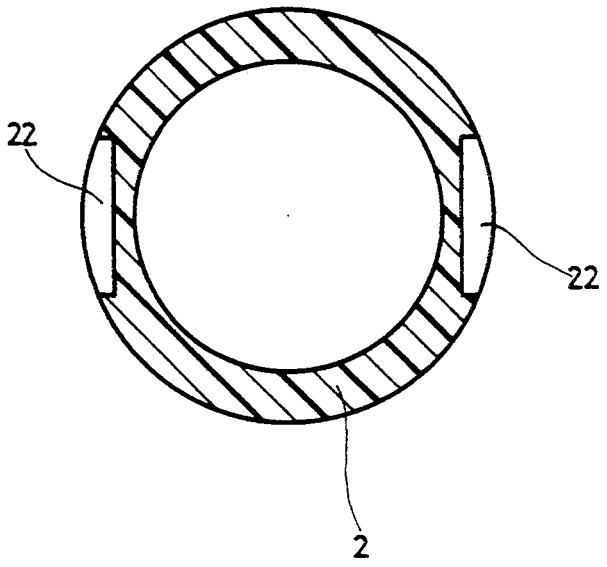
FIG. 5 is a cross-sectional drawing of another preferred embodiment of the invention herein.

The depth of the aforesaid grooves (22) on the center shaft (2) is not restricted, but to produce in principle a sufficient degree of anti-separation resistance without decreasing the strength of the central shaft, such as in a case wherein the outer diameter of a typical center shaft (2) is approximately 7.5 mm and the inner diameter is approximately 4.3 mm, indicating that the wall thickness of the shaft is $(7.5-4.3)\div 2=1.6$ mm, thus yielding a depth of approximately 0.3 mm to 0.5 mm is sufficient to attain the projected objective. Furthermore, the grooves (22) can, as indicated in FIG. 5, can be in the form of an insertion-type groove and all alterations to the form of these grooves shall be construed as modifications included under the claims of the invention herein. To cite another example, the rib supports (34) in the structure of the handle (3) are designed with the main objectives of reinforcing the tubular recess (33) and enabling the tubular recess to be utilized in the same manner as the center hole of a conventional wooden handle. Thus, the number and shape of the rib supports can be designed reflecting a range of modifications, and these modifications shall similarly be included under the technically protected claims of the invention herein.

Therefore, the main objectives of the invention herein are to provide a new structure for a badminton racket handle, wherein the handle is directly fixed to the end of the central shaft through the utilization of injection molding and wherein the end of the central shaft is completely embedded with a high degree of precision such that the poor quality attributed to misalignment due to the usage of conventional glue in the assembly process is eliminated, thereby reducing manufacturing costs.

Another objective of the invention herein is to provide new structure for a badminton racket handle having an end of the center shaft on which a number of grooves of appropriate depth can be placed in advance to enable the center shaft to be tightly embedded inside the handle during injection molding, and at the same time, the material quality of the grooves on the inserted center shaft is such that sufficient countering resistance is produced against torque, separation and other impact forces, thereby raising the value of badminton rackets and attaining excellent utilizing functions in badminton rackets.

What is claimed is:

1. A game racket structure comprising:

a) a tubular center shaft having a substantially circular cross-sectional configuration with a first end portion and a second end portion;

b) at least one groove defined by the second end portion extending in a chordal direction substantially across the tubular center shaft;

c) a handle attached to the second end portion of the tubular center shaft; and comprising:

i) a generally conical, hollow end section formed on one end of the handle opposite a butt section;

ii) a tubular member extending into the hollow, generally conical end section, the tubular member defining a cylindrical recess so as to tightly grip the second end portion of the tubular center shaft and having at least one protrusion engaging the at least one groove so as to prevent relative axial and rotational movement between the handle and the tubular center shaft; and, iii) at least one elongated rib support extending along and radially from the tubular member so as to connect the tubular member to the conical, hollow end section.

2. The game racket structure of claim 1 further comprising a pair of grooves defined by the second end portion and a pair of protrusions on the handle located such that one protrusion engages each groove.

3. The game racket structure of claim 2 wherein the pair of grooves are located at diametrically opposite positions on the tubular center shaft.

* * * * *